US012753620B2

(12) United States Patent
Zhang

(10) Patent No.: US 12,753,620 B2
(45) Date of Patent: Oct. 6, 2026

(54) POOL ROBOT

(71) Applicant: XINGMAI INNOVATION TECHNOLOGY (SUZHOU) CO., LTD., Suzhou (CN)

(72) Inventor: Shilei Zhang, Suzhou (CN)

(73) Assignee: XINGMAI INNOVATION TECHNOLOGY (SUZHOU) CO., LTD., Suzhou (CN)

( * ) Notice: Subject to any disclaimer, the term of this patent is extended or adjusted under 35 U.S.C. 154(b) by 0 days.

(21) Appl. No.: 19/323,814

(22) Filed: Sep. 9, 2025

(65) Prior Publication Data

US 2026/0009251 A1 Jan. 8, 2026

Related U.S. Application Data

(63) Continuation of application No. PCT/CN2023/116840, filed on Sep. 4, 2023.

(30) Foreign Application Priority Data

Mar. 20, 2023 (CN) ..... 202310269067.4

(51) Int. Cl.
*E04H 4/16* (2006.01)
*A47L 11/40* (2006.01)

(52) U.S. Cl.
CPC ..... *E04H 4/1654* (2013.01); *A47L 11/4027* (2013.01); *A47L 11/4075* (2013.01); *A47L 2201/00* (2013.01)

(58) Field of Classification Search
CPC ..... E04H 4/1654; E04H 4/1663; E04H 4/16
(Continued)

(56) References Cited

U.S. PATENT DOCUMENTS 4,064,586 A 12/1977 Caron
5,105,496 A 4/1992 Gray, Jr.
(Continued)

FOREIGN PATENT DOCUMENTS

CN 205805047 U 12/2016
CN 207700775 U † 8/2018
(Continued)

OTHER PUBLICATIONS

CN 218467262—Machine Translation (Year: 2023).*
(Continued)

*Primary Examiner* — Brian D Keller
*Assistant Examiner* — Alberto Saenz
(74) *Attorney, Agent, or Firm* — Soleado Law, PC

(57) ABSTRACT

This application provides a pool robot including a housing, a filtering box, and a water baffle plate. The housing is provided with a first water outlet hole and an accommodation cavity. The filtering box is disposed in the accommodation cavity. A second water outlet hole is disposed on a side wall of the accommodation cavity. The water baffle plate is connected to a side of the side wall of the accommodation cavity and provided over the second water outlet hole, where the side of the side wall is away from the filtering box. When the pool robot is located in water, the water baffle plate closes the second water outlet hole. When the pool robot leaves the water, the water baffle plate is opened, and water in the filtering box is drained from the housing sequentially through the second water outlet hole and the first water outlet hole.

19 Claims, 4 Drawing Sheets

(58) Field of Classification Search
USPC ..... 15/1.7; 210/167.16, 167.17, 143
See application file for complete search history.

(56) References Cited

U.S. PATENT DOCUMENTS

| | | | |
|---|---|---|---|
| 5,172,445 | A | 12/1992 | Chandler |
| 6,886,205 | B1 | 5/2005 | Pichon |
| 9,708,826 | B2 | 7/2017 | Michelon |
| 10,294,686 | B1 | 5/2019 | Erlich |
| 10,844,621 | B2 | 11/2020 | Klebanov |
| 2007/0028405 | A1 | 2/2007 | Garti |
| 2009/0277821 | A1 † | 11/2009 | Hui |
| 2011/0088182 | A1 | 4/2011 | Hui |
| 2013/0152316 | A1 | 6/2013 | Rief |
| 2014/0076789 | A1 | 3/2014 | Shlomi-Shlomi |
| 2015/0322684 | A1 * | 11/2015 | Renaud ..... E04H 4/1654 15/1.7 |
| 2016/0145884 | A1 | 5/2016 | Erlich |
| 2016/0298351 | A1 | 10/2016 | Blanc Tailleur |
| 2018/0163422 | A1 | 6/2018 | Klebanov |
| 2020/0095792 | A1 | 3/2020 | Miller |
| 2020/0270890 | A1 | 8/2020 | Schloss |
| 2024/0294242 | A1 | 9/2024 | Wei |
| 2025/0223823 | A1 | 7/2025 | Luo |

FOREIGN PATENT DOCUMENTS

| | | | | |
|---|---|---|---|---|
| CN | 208380175 | U | † | 1/2019 |
| CN | 210178034 | U | | 3/2020 |
| CN | 213049697 | U | | 4/2021 |
| CN | 214776472 | U | | 11/2021 |
| CN | 114278129 | A | | 4/2022 |
| CN | 216543395 | U | | 5/2022 |
| CN | 216553236 | U | | 5/2022 |
| CN | 115324395 | A | | 11/2022 |
| CN | 115492431 | A | | 12/2022 |
| CN | 218306593 | U | | 1/2023 |
| CN | 218467262 | U | * | 2/2023 |
| CN | 116060396 | A | | 5/2023 |
| CN | 116201405 | A | | 6/2023 |
| CN | 116517357 | A | | 8/2023 |
| EP | 1915496 | B1 | † | 2/2010 |
| WO | 2023273833 | A1 | | 1/2023 |

OTHER PUBLICATIONS

Search Report of CN2023102690674.
First Office Opinion Notice of CN2023102690674.
International Search Report of PCTCN2023116840.
Written Opinion of the International Searching Authority of PCTCN2023116840.
Non-Final Rejection of U.S. Appl. No. 19/031,492.

* cited by examiner
† cited by third party

POOL ROBOT

CROSS REFERENCE TO RELATED APPLICATIONS

This application is a continuation of International Patent Application No. PCT/CN2023/116840, filed with the World Intellectual Property Organization on Sep. 4, 2023, which claims priority to Chinese Patent Application No. 202310269067.4, filed with the China National Intellectual Property Administration on Mar. 20, 2023 and entitled "POOL ROBOT", which is incorporated herein by reference in its entirety.

TECHNICAL FIELD

This application relates to the technical field of pool working devices, and in particular, to a pool robot.

BACKGROUND

As an automatic device working in a pool, a pool robot can automatically complete work such as pool cleaning, thereby reducing time for a user. Therefore, the pool robot is widely praised by the user.

However, because the pool robot works in water, there are two common problems of the pool robot in the conventional technology, which greatly affect user experience but have not been resolved for a long time. First, when the pool robot is in water, there is a large amount of water inside the pool robot, so it is necessary to take significant effort to extract the pool robot from the water. Second, after the pool robot is extracted from a water surface, the water inside the pool robot needs to be drained, but a drainage speed is slow.

SUMMARY

An objective of this application is to propose a pool robot, which can improve a drainage speed of the pool robot in a process of leaving water, quickly reduce a weight of the pool robot, and therefore help improve user experience.

To achieve the objective, this application uses the following technical solutions. In an embodiment, a pool robot includes a housing, an accommodation cavity disposed in the housing, where the accommodation cavity is provided with at least one water inlet hole; a filtering box disposed in the accommodation cavity; a filter driving assembly, where under an action of the filter driving assembly, water enters the filtering box, and the water filtered by the filtering box enters the filter driving assembly through the at least one water inlet hole and is drained from the housing to form a first water flow path used for cleaning the water; a plurality of first water outlet holes disposed on the housing; and at least one second water outlet hole disposed on the accommodation cavity. In a process in which the pool robot is leaving water in a tilt state, some of the plurality of first water outlet holes are located lower than the at least one second water outlet hole, so that the filtering box, the accommodation cavity, the at least one second water outlet hole, and the at least one first water outlet hole are sequentially in fluid communication to form a second water flow path used for water in the housing to be quickly drained from the housing.

In an optional solution, the at least one first water outlet hole is disposed at a bottom of the housing.

In an optional solution, the at least one second water outlet hole is disposed on at least one side wall of the accommodation cavity.

In an optional solution, the pool robot further includes a water baffle plate provided over the at least one second water outlet hole. When the pool robot is located in the water, the water baffle plate closes the at least one second water outlet hole, and in the process in which the pool robot is leaving the water, the at least one first water outlet hole is located lower than the at least one second water outlet hole, and the water baffle plate does not close the at least one second water outlet hole, so that the filtering box, the accommodation cavity, the at least one second water outlet hole, and the at least one first water outlet hole are sequentially in fluid communication to form the second water flow path.

In an optional solution, the pool robot further includes at least one first cavity disposed in the housing and separated from the accommodation cavity. The accommodation cavity communicates with the at least one first cavity through the at least one water inlet hole. At least a part of the filter driving assembly is disposed in the at least one first cavity. Under the action of the filter driving assembly, the filtering box, the accommodation cavity, the at least one water inlet hole, the at least one first cavity, and the filter driving assembly are sequentially in fluid communication to form the first water flow path.

In an optional solution, the pool robot further includes at least one liquid inlet disposed on the filtering box, where the water enters the filtering box through the at least one liquid inlet.

In an optional solution, the pool robot further includes at least one first water inlet disposed on the housing and communicating with the at least one liquid inlet; and at least one third water outlet hole disposed on the housing. Under the action of the filter driving assembly, the at least one first water inlet, the at least one liquid inlet, the filtering box, the accommodation cavity, the at least one water inlet hole, the at least one first cavity, the filter driving assembly, and the at least one third water outlet hole are sequentially in fluid communication to form the first water flow path.

In an optional solution, the filter driving assembly includes at least an impeller. Under the action of the filter driving assembly, the at least one first water inlet, the at least one liquid inlet, the filtering box, the accommodation cavity, the at least one water inlet hole, the at least one first cavity, the impeller, and the at least one third water outlet hole are sequentially in fluid communication to form the first water flow path.

In an optional solution, the at least one first water inlet is disposed at a bottom of the housing, and the at least one third water outlet hole is disposed at a top of the housing.

In an optional solution, the pool robot further includes at least one second water inlet disposed at a bottom of the accommodation cavity and communicating with the at least one first water inlet. The at least one second water inlet is located between the at least one first water inlet and the at least one liquid inlet, and the at least one first water inlet, the at least one second water inlet, and the at least one liquid inlet are sequentially in fluid communication.

In an optional solution, the at least one first water inlet communicates with the at least one second water inlet through a water guiding duct.

In an optional solution, at least a part of the water guiding duct is located outside the accommodation cavity.

In an optional solution, at least a part of the filter driving assembly faces the at least one water inlet hole.

In an optional solution, at least a part of the filter driving assembly and/or a water drainage direction of the filter driving assembly face/faces the at least one third water outlet hole.

In an optional solution, one end of at least a part of the filter driving assembly is in fluid communication with the at least one water inlet hole, and the other end is in fluid communication with the at least one third water outlet hole.

In an optional solution, the at least one third water outlet hole is located at a top of the at least one first cavity.

In an optional solution, the filter driving assembly further includes a motor configured to drive the impeller to rotate.

In an optional solution, the pool robot further includes the at least one first cavity, where the impeller is disposed in the at least one first cavity; and a second cavity separated from both the accommodation cavity and the at least one first cavity, where the motor is disposed in the second cavity.

In an optional solution, the second cavity is located below the at least one first cavity.

In an optional solution, when the pool robot is leaving the water in the tilt state, a bottom of the housing and a horizontal plane form an included angle of 45° to 75°.

BRIEF DESCRIPTION OF DRAWINGS

To describe technical solutions in embodiments of this application more clearly, the following briefly introduces the accompanying drawings required for describing embodiments of this application. It is clear that the accompanying drawings in the following description show merely some embodiments of this application, and a person of ordinary skill in the art may still derive other drawings from the content of embodiments of this application and these accompanying drawings without creative efforts.

REFERENCE NUMERALS

Figure 1:
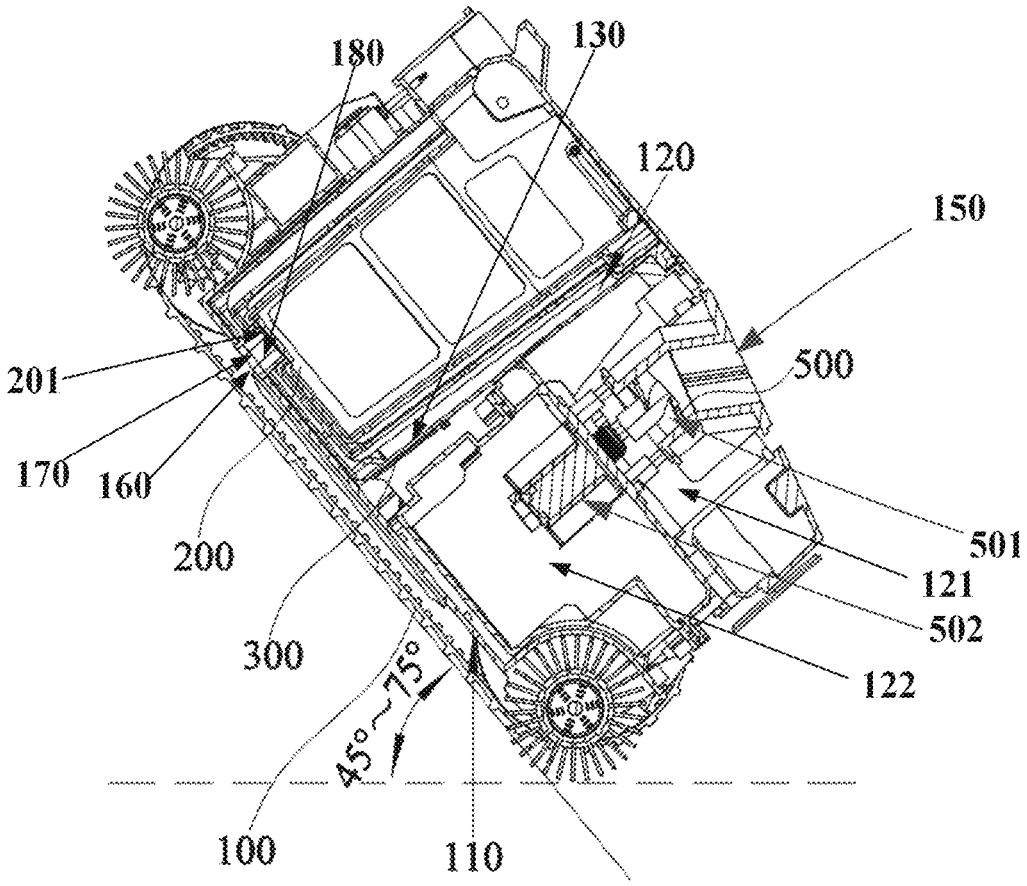
FIG. 1 is a diagram 1 of a cross-sectional structure of a pool robot according to an embodiment of this application.

100: housing; 110: first water outlet hole; 120: accommodation cavity; 121: first cavity; 122: second cavity; 130: second water outlet hole; 140: water inlet hole; 150: third water outlet hole; 160: first water inlet; 170: second water inlet; 180: water guiding duct; 200: filtering box; 201: liquid inlet; 300: water baffle plate; 400: handle; 500: filter driving assembly; 501: impeller; 502: motor.

DESCRIPTION OF EMBODIMENTS

The following further describes this application with reference to the accompanying drawings and embodiments. It may be understood that the specific embodiments described herein are merely used to explain this application, but are not intended to limit this application. In addition, it should be noted that, for ease of description, only a part but not all of a structure related to this application is shown in the accompanying drawings.

In descriptions of this application, unless otherwise expressly specified and limited, the terms such as "link", "connect", and "fasten" should be understood broadly. For example, the term "connect" may indicate a fixed connection, a detachable connection, or an integral connection, may indicate a mechanical connection or an electrical connection, or may indicate a direct connection, an indirect connection implemented through an intermediate medium, or communication between internal structures of two elements or an interaction relationship between two elements. A person of ordinary skill in the art may understand specific meanings of the foregoing terms in this application based on a specific situation.

In this application, unless otherwise expressly specified and limited, that a first feature is "above" or "below" a second feature may be that the first feature may be in direct contact with the second feature, or the first feature may be in contact with the second feature through another feature between the first feature and the second feature instead of being in direct contact with the second feature. In addition, that the first feature is "above", "on", or "over" the second feature may be that the first feature is right above or obliquely above the second feature, or merely mean that a horizontal height of the first feature is greater than that of the second feature. That the first feature is "below", "underneath", or "under" the second feature may be that the first feature is right below or obliquely below the second feature, or merely mean that a horizontal height of the first feature is less than that of the second feature.

In descriptions of embodiments, an orientation or position relationship indicated by terms "above", "below", "left", "right", and the like is an orientation or position relationship based on the accompanying drawings, and is only intended to facilitate descriptions and simplify operations, but is not intended to indicate or imply that an apparatus or an element needs to have a specific orientation and be constructed and operated in a specific orientation. Therefore, such terms cannot be understood as a limitation on this application. In addition, the terms "first" and "second" are merely used to distinguish in description and have no special meaning.

As shown in FIG. 1 to FIG. 4, an embodiment provides a pool robot, and the pool robot works in a pool. Currently, a commonly used pool robot is mainly configured to clean a bottom surface and a wall surface of a pool. The pool robot includes a housing 100 and a filtering box 200. The housing 100 is provided with an accommodation cavity 120. The filtering box 200 is disposed in the accommodation cavity 120. The pool robot further includes a filter driving assembly 500. The filtering box 200 is provided with a liquid inlet 201 and a liquid outlet. The filter driving assembly 500 can drive the pool robot to suck water in the pool. The water enters the filtering box 200 through the liquid inlet 201, garbage remains in the filtering box 200 after the water is filtered by the filtering box 200, and cleaned liquid is drained from the liquid outlet.

When the pool robot works in water, water enters the housing 100 through various gaps on the housing 100. Therefore, a large amount of water remains inside a body of the pool robot. When a user lifts the pool robot out of a water surface, a weight of the pool robot is large due to a weight of the water in the housing 100, and the user needs to take significant effort to lift the body out of the water surface. After the body is lifted out of the water surface, due to a slow drainage speed of the housing 100, it takes a long time to completely drain the water in the housing 100, which is time-consuming and poor in user experience.

Figure 2:
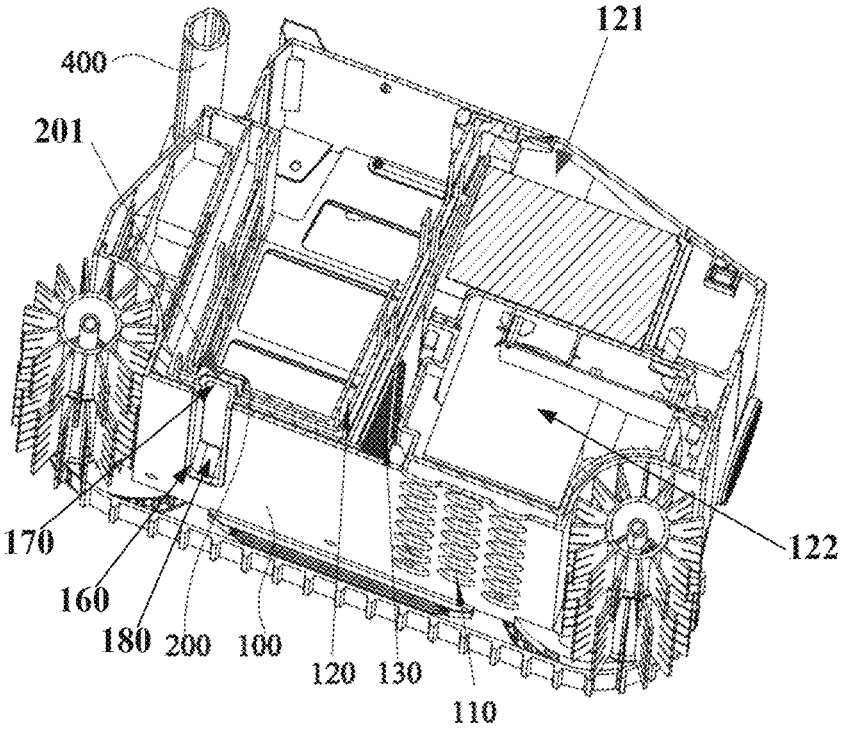
FIG. 2 is a diagram 2 of a cross-sectional structure of a pool robot according to an embodiment of this application.

As shown in FIG. 1 and FIG. 2, in this embodiment, a lower end surface of the housing 100 is provided with a first water outlet hole 110, so that the water inside the housing 100 can be quickly drained from the first water outlet hole 110 in or after a process in which the pool robot is leaving the water (that is, leaving the water surface). A side wall of the accommodation cavity 120 is provided with a second water outlet hole 130. The pool robot further includes a water baffle plate 300. A part of the water baffle plate 300 is connected to a side of the side wall of the accommodation cavity 120, and the side of the side wall is away from the filtering box 200, that is, the water baffle plate 300 is partially connected to the side of the side wall of the accommodation cavity 120, and the side of the side wall is away from the filtering box 200. The water baffle plate 300 is provided over the second water outlet hole 130. When the pool robot is located in water, the water baffle plate 300 closes the second water outlet hole 130 to avoid the following case: Water enters the filtering box 200 through the second water outlet hole 130, affecting working efficiency of the pool robot. In or after the process in which the pool robot is leaving the water (that is, leaving the water surface), the water baffle plate 300 is opened, and water in the filtering box 200 can flow out through the second water outlet hole 130 and be drained from the housing 100 through the first water outlet hole 110, so that the water in the filtering box 200 is quickly drained. This improves a drainage speed of the pool robot in the process of leaving the water, quickly reduces the weight of the pool robot, and therefore helps improve user experience. In a process in which the pool robot enters the water, the water can enter the inside of the housing 100 through the first water outlet hole 110. This helps quickly increase the weight of the pool robot, so that the pool robot quickly enters the water, and therefore improves water entry efficiency of the pool robot.

Optionally, the water baffle plate 300 is made of a flexible waterproof material. When the pool robot is in water, the water baffle plate 300 can be attached to an outer side of the side wall under the action of water pressure inside and outside the second water outlet hole 130, so that the water in the filtering box 200 does not flow out through the second water outlet hole 130, and outside water cannot enter through the second water outlet hole 130. When the pool robot leaves the water, because the water outside the filtering box 200 is quickly drained from the first water outlet hole 110, pressure outside the filtering box 200 decreases, and a part of the water baffle plate 300 is opened under a force of gravity, where the part is not connected to the side wall, to be separated from the side wall to form a gap, so that the water is capable of being quickly drained from the gap. The water baffle plate 300 can selectively close the second water outlet hole 130 without any additional driving force. This can reduce costs and help simplify a structure of the pool robot.

In other embodiments, the water baffle plate 300 includes a body and a rotating shaft. The body is provided over the second water outlet hole 130, the rotating shaft is disposed between the side wall and the body, and the rotating shaft is located at an upper side of the second water outlet hole 130. The body is rotatably connected to the rotating shaft, so that when the pool robot leaves the water, the body can be driven to rotate under a force of gravity of the water to open the second water outlet hole 130. It should be noted that "above" herein indicates a side of the pool robot and away from the ground when the pool robot is located on the ground.

Optionally, a surface area of the water baffle plate 300 facing the second water outlet hole 130 is greater than an area of the second water outlet hole 130, so that the water baffle plate 300 can fully cover the second water outlet hole 130. Optionally, a part of perimetrical boundary of the water baffle plate 300 is connected to the side wall, that is, the perimetrical boundary of the water baffle plate 300 is intermittently connected to the side wall, so that after the pool robot leaves the water, the water in the filtering box 200 can overflow from the part of the water baffle plate 300, where the part is not connected to the side wall. Specifically, that the perimetrical boundary of the water baffle plate 300 is intermittently connected to the side wall may be that each side of the water baffle plate 300 is partially connected to the side wall, so that when the pool robot is located underwater, the water in the filtering box 200 is prevented from flowing out through the second water outlet hole 130 by using water pressure outside the side wall. However, after the pool robot leaves the water surface, the water pressure outside the water baffle plate 300 disappears. In this case, under the action of water pressure inside the filtering box 200, the part of the water baffle plate 300, where the part is not connected to the side wall, is driven to be separated from the side wall, so that the water in the filtering box 200 can flow out through the second water outlet hole 130. Certainly, that the perimetrical boundary of the water baffle plate 300 is intermittently connected to the side wall may alternatively be that at least one side of the water baffle plate 300 is connected to the side wall, the side includes at least an upper side of the water baffle plate 300, and the upper side is away from the ground, so that when the pool robot leaves the water, the side of the water baffle plate 300, where the side is not connected to the side wall, can be separated from the side wall to open the second water outlet hole 130. This helps quickly drain water and therefore ensures drainage efficiency.

In addition, as shown in FIG. 1 and FIG. 2, the second water outlet hole 130 is provided close to the lower end surface of the housing 100, so that the water in the filtering box 200 can be fully drained, and residues are reduced.

Optionally, there are a plurality of first water outlet holes 110, and the plurality of first water outlet holes 110 are provided in an array. There are a plurality of second water outlet holes 130, and the plurality of second water outlet holes 130 are arranged in an array. This helps expand a drainage area and ensure drainage stability. Optionally, the first water outlet hole 110 and the second water outlet hole 130 are circular holes or grid holes.

Optionally, the pool robot further includes a filter member. The filter member is disposed on an inner wall of the filtering box 200, and the inner wall corresponds to the second water outlet hole 130, to prevent garbage in the filtering box 200 from being carried out during drainage.

Optionally, an area of the first water outlet hole 110 ranges from 2000 $mm^2$ to 6000 $mm^2$, thereby ensuring a sufficient drainage area and improving drainage efficiency.

Figure 3:
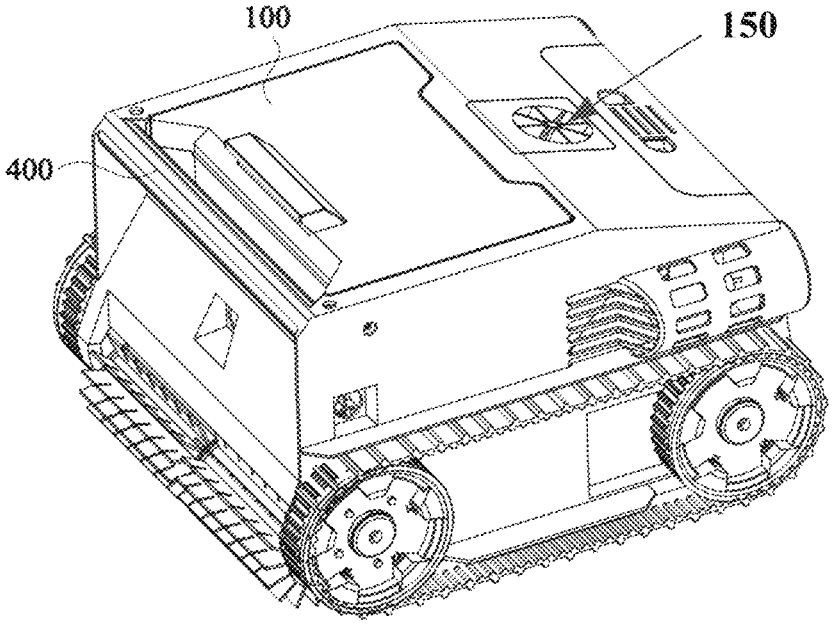
FIG. 3 is a diagram 1 of a structure of a pool robot according to an embodiment of this application.

As shown in FIG. 2 and FIG. 3, the pool robot further includes a handle 400 disposed at a front end of the housing 100. This is convenient for a user to hold the pool robot. When the handle 400 is lifted, the side wall provided with the second water outlet hole 130 tilts. It should be noted that the front end is an end located in the front when the pool robot moves forward. In this way, liquid in the filtering box 200 is drained from the second water outlet hole 130 under a force of gravity. This can not only ensure the drainage efficiency, but also improve a drainage proportion, thereby preventing water from remaining in the filtering box 200.

In addition, to fully drain the water inside the housing 100, an internal structure of the pool robot does not have an obvious right angle or dead angle. This prevents the internal water from remaining and not being fully drained for a long time. Optionally, when the handle 400 is lifted, the lower end surface of the housing 100 and a horizontal plane form an included angle of 45° to 75°, so that the water naturally flows out under a force of gravity. This helps increase the drainage proportion. In this embodiment, in a state in which the handle 400 is lifted, the lower end surface of the housing 100 and a horizontal plane form the included angle of 45°.

In this embodiment, in a state in which the handle 400 is lifted, the first water outlet hole 110 is close to a lowest point of the housing 100. Because the water flows downward under a force of gravity when the user holds the handle 400 and lifts the pool robot, the first water outlet hole 110 is provided close to the lowest point of the housing 100 when the user holds the handle 400. This helps reduce water remaining inside the housing 100 and improve the drainage proportion.

Figure 4:
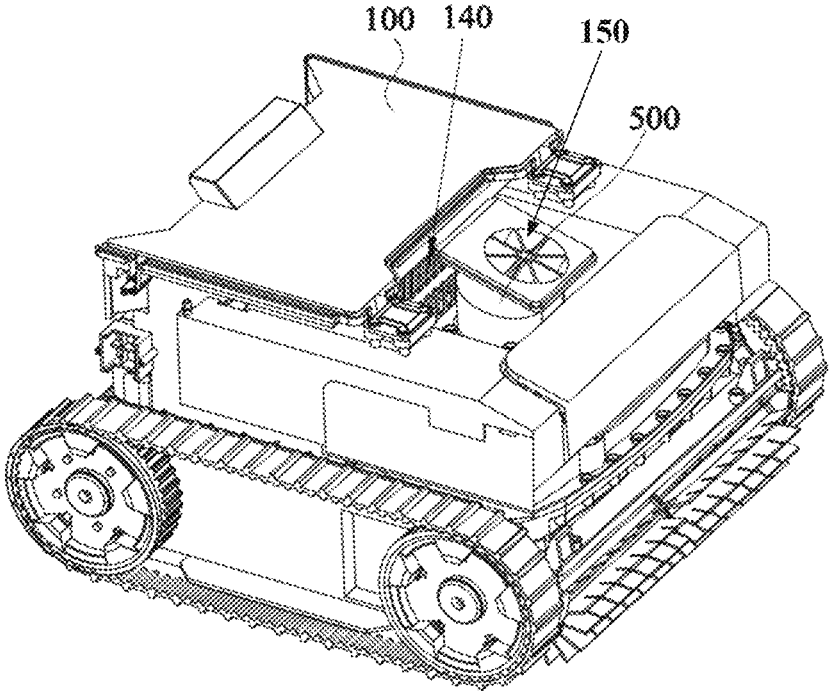
FIG. 4 is a diagram 2 of a structure of a pool robot according to an embodiment of this application.

Refer to FIG. 4. Side walls of the filtering box 200 and the accommodation cavity 120 are each provided with a water inlet hole 140. The water inlet hole 140 is provided close to an upper end surface of the housing 100. When the pool robot enters water, water outside the housing 100 can enter the filtering box 200 through the water inlet hole 140. This helps quickly increase the weight of the pool robot, so that the pool robot quickly enters the water, and therefore improves the water entry efficiency of the pool robot.

Optionally, the water inlet hole 140 is a grid hole, and an opening area of the grid hole is large. This helps improve the water entry efficiency.

It can be understood that at least a part of the filter driving assembly 500 is disposed outside the water inlet hole 140. When the pool robot works in water, the filter driving assembly 500 can drive water and garbage to enter the liquid inlet of the filtering box 200. After the water and the garbage are filtered by the filtering box 200, the garbage remains in the filtering box 200, and the water is drained to the filter driving assembly 500 through the liquid outlet and the water inlet hole 140, and then is drained from the housing 100 along a preset path.

Optionally, the pool robot further includes at least one first cavity 121 disposed in the housing 100 and separated from the accommodation cavity 120. The accommodation cavity 120 communicates with the at least one first cavity 121 through the at least one water inlet hole 140.

Optionally, the pool robot further includes at least one first water inlet 160 disposed on the housing 100 and communicating with the at least one liquid inlet 201; and at least one third water outlet hole 150 disposed on the housing 100.

Optionally, the filter driving assembly 500 includes at least an impeller 501.

Optionally, the pool robot further includes at least one second water inlet 170 disposed at a bottom of the accommodation cavity 120 and communicating with the at least one first water inlet 160. The at least one second water inlet 170 is located between the at least one first water inlet 160 and the at least one liquid inlet 201, and the at least one first water inlet 160, the at least one second water inlet 170, and the at least one liquid inlet 201 are sequentially in fluid communication.

Optionally, the at least one first water inlet 160 communicates with the at least one second water inlet 170 through a water guiding duct 180.

Optionally, the filter driving assembly 500 further includes a motor 502 configured to drive the impeller 501 to rotate.

Optionally, the pool robot further includes the at least one first cavity 121, where the impeller 501 is disposed in the at least one first cavity 121; and a second cavity 122 separated from both the accommodation cavity 120 and the at least one first cavity 121, where the motor 502 is disposed in the second cavity 122.

It should be noted that the foregoing shows and describes basic principles and main features of this application and advantages of this application. A person skilled in the art should understand that this application is not limited to the forgoing embodiments, the foregoing embodiments and this specification only describe principles of this application, and various changes and modifications may be made to this application without departing from the spirit and scope of this application. These changes and modifications fall within the protection scope claimed in this application. The protection scope claimed in this application is defined by the appended claims and equivalents thereof.

The invention claimed is:

1. A pool robot, comprising:

a housing;

an accommodation cavity disposed in the housing, wherein the accommodation cavity is provided with at least one water inlet hole;

a filtering box disposed in the accommodation cavity;

a filter driving assembly, wherein under an action of the filter driving assembly, unfiltered water first enters the filtering box, the unfiltered water is filtered by the filtering box to form filtered water, and the filtered water enters the filter driving assembly through the at least one water inlet hole and is drained from the housing to form a first water flow path used for cleaning water;

a plurality of first water outlet holes disposed on the housing;

at least one second water outlet hole disposed on the accommodation cavity; and a water baffle plate provided over the at least one second water outlet hole, wherein when the pool robot is located in the water, the water baffle plate closes the at least one second water outlet hole, and in a process in which the pool robot is leaving the water in a tilt state, some of the plurality of first water outlet holes are located lower than the at least one second water outlet hole, and the water baffle plate does not close the at least one second water outlet hole, so that the filtering box, the accommodation cavity, the at least one second water outlet hole, and the plurality of first water outlet holes are sequentially in fluid communication to form a second water flow path used for water in the housing to be quickly drained from the housing.

2. The pool robot according to claim 1, wherein the plurality of first water outlet holes is disposed at a bottom of the housing.

3. The pool robot according to claim 1, wherein the at least one second water outlet hole is disposed on at least one side wall of the accommodation cavity.

4. The pool robot according to claim 1, further comprising at least one first cavity disposed in the housing and separated from the accommodation cavity, wherein the accommodation cavity communicates with the at least one first cavity through the at least one water inlet hole;

at least a part of the filter driving assembly is disposed in the at least one first cavity; and under the action of the filter driving assembly, the filtering box, the accommodation cavity, the at least one water inlet hole, the at least one first cavity, and the filter driving assembly are sequentially in fluid communication to form the first water flow path.

5. The pool robot according to claim 4, further comprising at least one liquid inlet disposed on the filtering box, wherein the water enters the filtering box through the at least one liquid inlet.

6. The pool robot according to claim 5, further comprising:

at least one first water inlet disposed on the housing and communicating with the at least one liquid inlet; and at least one third water outlet hole disposed on the housing, wherein under the action of the filter driving assembly, the at least one first water inlet, the at least one liquid inlet, the filtering box, the accommodation cavity, the at least one water inlet hole, the at least one first cavity, the filter driving assembly, and the at least one third water outlet hole are sequentially in fluid communication to form the first water flow path.

7. The pool robot according to claim 6, wherein the filter driving assembly comprises at least an impeller, wherein under the action of the filter driving assembly, the at least one first water inlet, the at least one liquid inlet, the filtering box, the accommodation cavity, the at least one water inlet hole, the at least one first cavity, the impeller, and the at least one third water outlet hole are sequentially in fluid communication to form the first water flow path.

8. The pool robot according to claim 7, wherein the filter driving assembly further comprises a motor configured to drive the impeller to rotate.

9. The pool robot according to claim 8, further comprising:

the at least one first cavity, wherein the impeller is disposed in the at least one first cavity; and a second cavity separated from both the accommodation cavity and the at least one first cavity, wherein the motor is disposed in the second cavity.

10. The pool robot according to claim 9, wherein the second cavity is located below the at least one first cavity.

11. The pool robot according to claim 6, wherein the at least one first water inlet is disposed at a bottom of the housing, and the at least one third water outlet hole is disposed at a top of the housing.

12. The pool robot according to claim 6, further comprising at least one second water inlet disposed at a bottom of the accommodation cavity and communicating with the at least one first water inlet, wherein the at least one second water inlet is located between the at least one first water inlet and the at least one liquid inlet, and the at least one first water inlet, the at least one second water inlet, and the at least one liquid inlet are sequentially in fluid communication.

13. The pool robot according to claim 12, wherein the at least one first water inlet communicates with the at least one second water inlet through a water guiding duct.

14. The pool robot according to claim 13, wherein at least a part of the water guiding duct is located outside the accommodation cavity.

15. The pool robot according to claim 6, wherein at least a part of the filter driving assembly and/or a water drainage direction of the filter driving assembly face/faces the at least one third water outlet hole.

16. The pool robot according to claim 15, wherein one end of at least a part of the filter driving assembly is in fluid communication with the at least one water inlet hole, and the other end is in fluid communication with the at least one third water outlet hole.

17. The pool robot according to claim 6, wherein the at least one third water outlet hole is located at a top of the at least one first cavity.

18. The pool robot according to claim 1, wherein at least a part of the filter driving assembly faces the at least one water inlet hole.

19. The pool robot according to claim 1, wherein when the pool robot is leaving the water in the tilt state, a bottom of the housing and a horizontal plane form an included angle of 45° to 75°.

* * * * *